US008313314B2

(12) United States Patent
Favre

(10) Patent No.: US 8,313,314 B2
(45) Date of Patent: Nov. 20, 2012

(54) FLUID CIRCULATION DEVICE

(75) Inventor: Olivier Favre, Geneva (CH)

(73) Assignee: Infomed S.A., Acacias (CH)

( * ) Notice: Subject to any disclaimer, the term of this patent is extended or adjusted under 35 U.S.C. 154(b) by 1190 days.

(21) Appl. No.: 12/141,116

(22) Filed: Jun. 18, 2008

(65) Prior Publication Data

US 2009/0010777 A1 Jan. 8, 2009

(30) Foreign Application Priority Data

Jun. 21, 2007 (EP) ..... 07012107

(51) Int. Cl.
*F04B 45/04* (2006.01)

(52) U.S. Cl. ..... 417/413.1

(58) Field of Classification Search ..... 417/395, 417/412, 413.1, 394; 92/96, 98 R, 99
See application file for complete search history.

(56) References Cited

U.S. PATENT DOCUMENTS

| | | | | |
|---|---|---|---|---|
| 2,229,038 | A * | 1/1941 | Booth | 417/384 |
| 2,920,573 | A | 12/1957 | Schaurte | |
| 2,998,256 | A * | 8/1961 | Lipkins | 279/3 |
| 3,027,848 | A * | 4/1962 | Merkle | 417/564 |
| 5,554,011 | A | 9/1996 | Bales et al. | |
| 5,667,368 | A * | 9/1997 | Augustyn et al. | 417/385 |
| 5,860,793 | A | 1/1999 | Muscarella et al. | |
| 5,958,634 | A | 9/1999 | Stephenson | |
| 6,814,547 | B2 * | 11/2004 | Childers et al. | 417/53 |

FOREIGN PATENT DOCUMENTS

| | | |
|---|---|---|
| EP | 0 307 069 | 4/1988 |
| FR | 1.402.976 | 4/1964 |
| GB | 2 431 439 A | 4/2007 |

OTHER PUBLICATIONS

Written Opinion, dated Mar. 18, 2011, in Application No. 07012107.4.
European Search Report dated Nov. 20, 2007.

* cited by examiner

*Primary Examiner* — Devon Kramer
*Assistant Examiner* — Bryan Lettman
(74) *Attorney, Agent, or Firm* — Young & Thompson

(57) ABSTRACT

A fluid circulation device includes a circuit of the fluid to be pumped, with a rigid cavity closed off by a soft membrane that cooperates with drive members driven by a motor in to-and-fro movements. The face of the drive members intended to cooperate with membrane is connected via a conduit to a vacuum pump able to apply by suction the membrane against the face of the drive members, so as to create a rigid connection between the drive members and the membrane that then exactly follows the to-and-fro movements imposed by the drive members.

18 Claims, 7 Drawing Sheets

FLUID CIRCULATION DEVICE

BACKGROUND OF THE INVENTION

1. Field of the Invention

The present invention relates to a fluid circulation device comprising at least one membrane pump for fluid circulation in a given direction, and with a given flowrate, thanks to the to-and-from movements of the membrane that are coordinated with the opening and closing of valves situated upstream and downstream of the rigid cavity within which the membrane moves.

2. Description of the Related Art

The prior art describes numerous membrane pumps that may be separated into two categories: those having a rigid connection between the membrane and its drive system, and those where the membrane is moved via a fluid. This latter solution has the advantage of admitting a membrane change every time the pump is used, and thus avoiding the transmission of polluting or contaminating elements to the fluid pumped. The elasticity of such a connection, to the contrary, has negative effects on the fluid flow precision in each pumping cycle and on its sensitivity to external parameters such as the pressure of the fluid pumped. The prior art more precisely describes numerous systems using pumps having a membrane acted upon by a gas, generally air, so that to-and-from movements of this membrane are created that in alternation, and combined with valve movements, fill and then empty a rigid chamber that is closed off by this soft membrane, thus producing a circulation of the fluid present in the chamber. These pumps as described in the prior art all include a membrane having a flexibility allowing the volume to be varied that is available to produce fluid circulation, one or several valves, as well as a rigid tank set up on the other side of the membrane that takes up the gas intended to actuate said membrane.

From the document U.S. Pat. No. 5,938,634 in particular a system for peritoneal dialysis is known that is driven by variable pressure and includes membrane pumps and valves that are used for the propulsion and directional control of the fluid. From the document U.S. Pat. No. 5,554,011 a membrane pump is known that is actuated by a vacuum and comprises a piston that is subject to the action of a return spring.

The disadvantage of known fluid circulation devices using membrane pumps controlled by a gaseous fluid resides mainly in the difficulty of knowing and determining with precision the quantity or volume of the fluid to be pumped that is displaced in each to-and-from cycle of the membrane. This difficulty arises more particularly from the fact that the volume variation of the air as a compressible fluid used to actuate the membrane does not correspond to the fluid volume to be pumped that is displaced by the membrane, the reasons being compression of the air, the pressure, and the temperatures.

SUMMARY OF THE INVENTION

It is an object of the present invention to realize a fluid circulation device comprising at least one membrane pump within which the displacement of the membrane and hence the fluid volume displaced can be known and determined precisely, and without being subject to any significant influence of external parameters such as the pressure of the fluid to be circulated.

It is another object of the present invention to realize a fluid circulation device with several simple, robust, and reliable membrane pumps that can be used in particular in the medical field, and thus avoids all contact between the fluid to be circulated, and parts potentially contaminated.

The object of the present invention is a fluid circulation device containing at least one membrane pump that tends to obviate the disadvantages cited above, and comprises the characteristics listed in claim 1.

BRIEF DESCRIPTION OF THE DRAWING FIGURES

The annexed drawing illustrates schematically and by way of example an embodiment of the fluid circulation device according to the invention.

Figure 3:
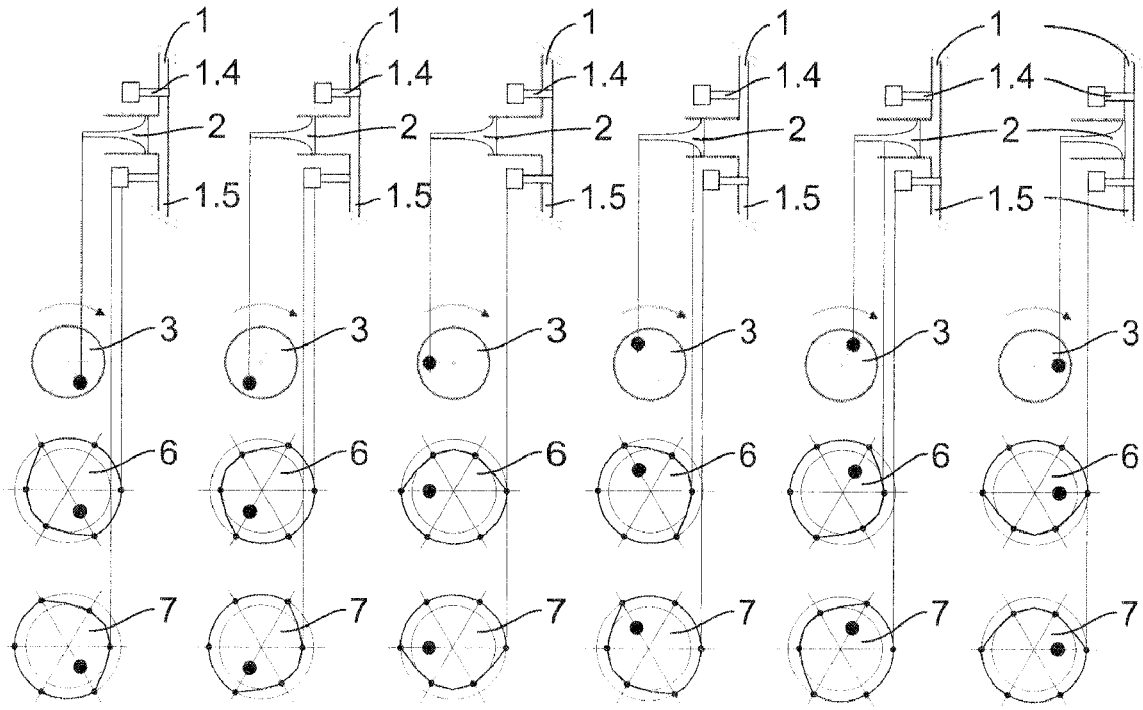

FIG. 3 schematically illustrates the functioning of the membrane pump and of the valves connected upstream and downstream of the pump.

Figure 4:
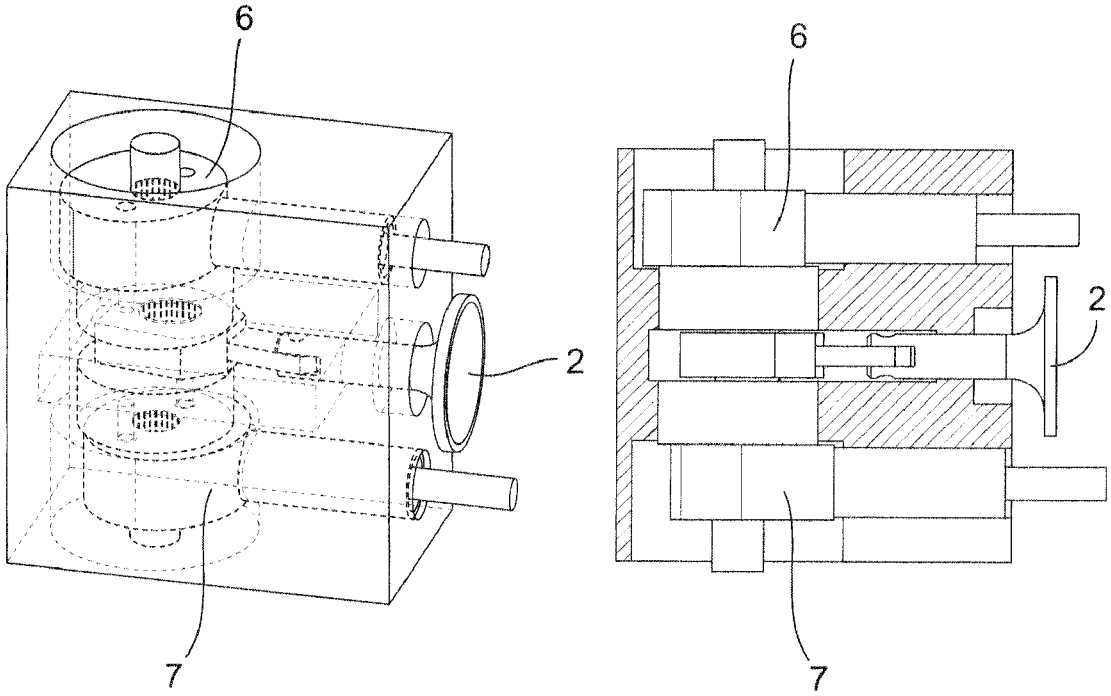

FIG. 4 schematically illustrates in perspective and in section the drive means of the membrane pump and valves.

Figure 5:
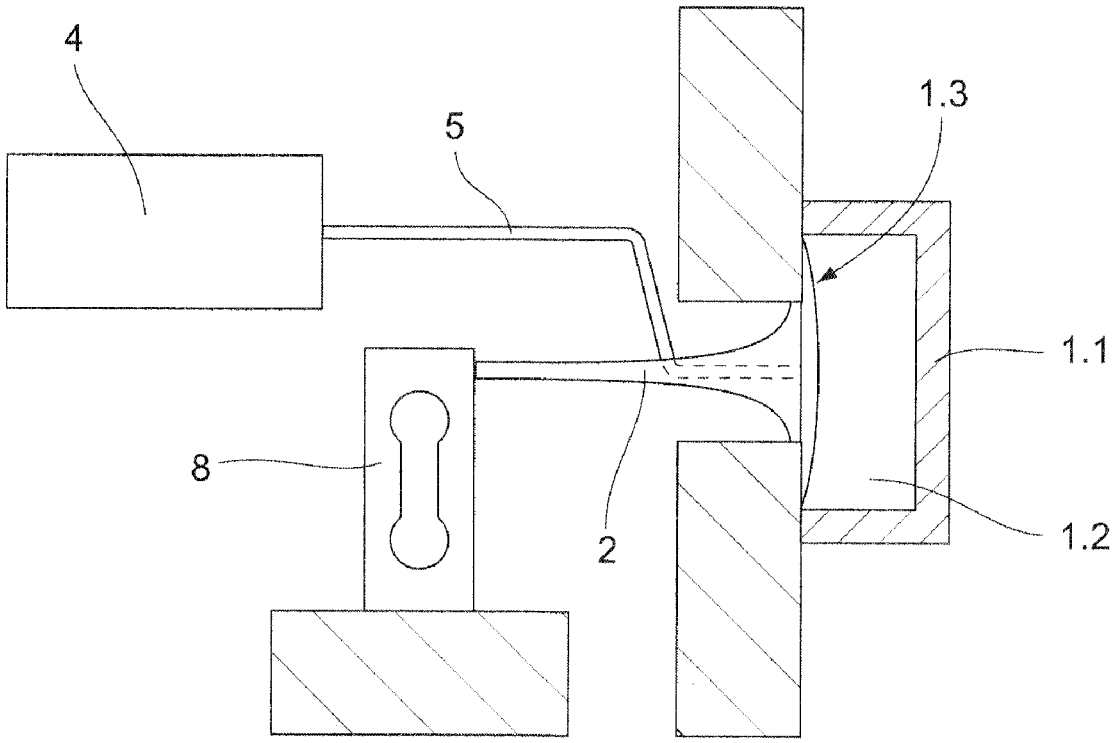

FIG. 5 is a basic scheme of a pressure sensor contained in the fluid circulation device.

Figure 6:
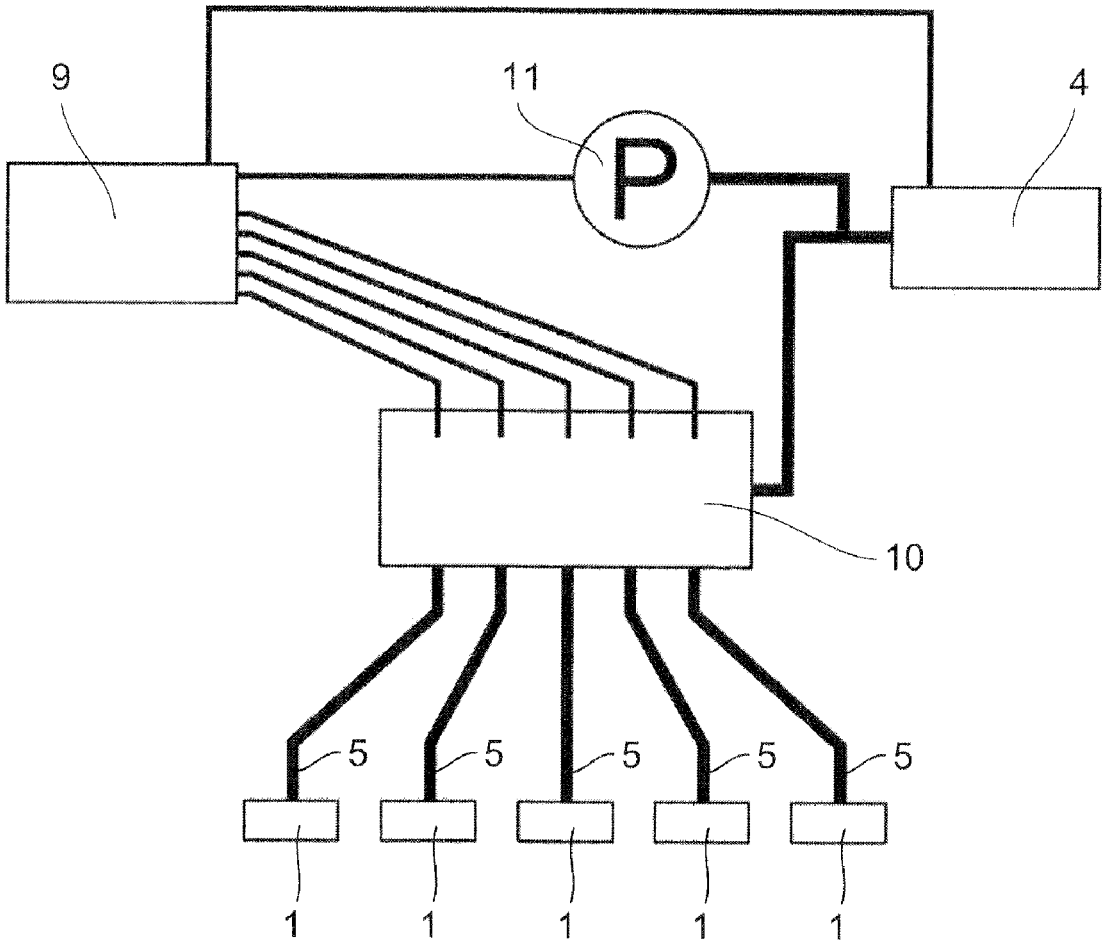

FIG. 6 illustrates a device according to the invention comprising several fluid circulation circuits.

Figure 7:
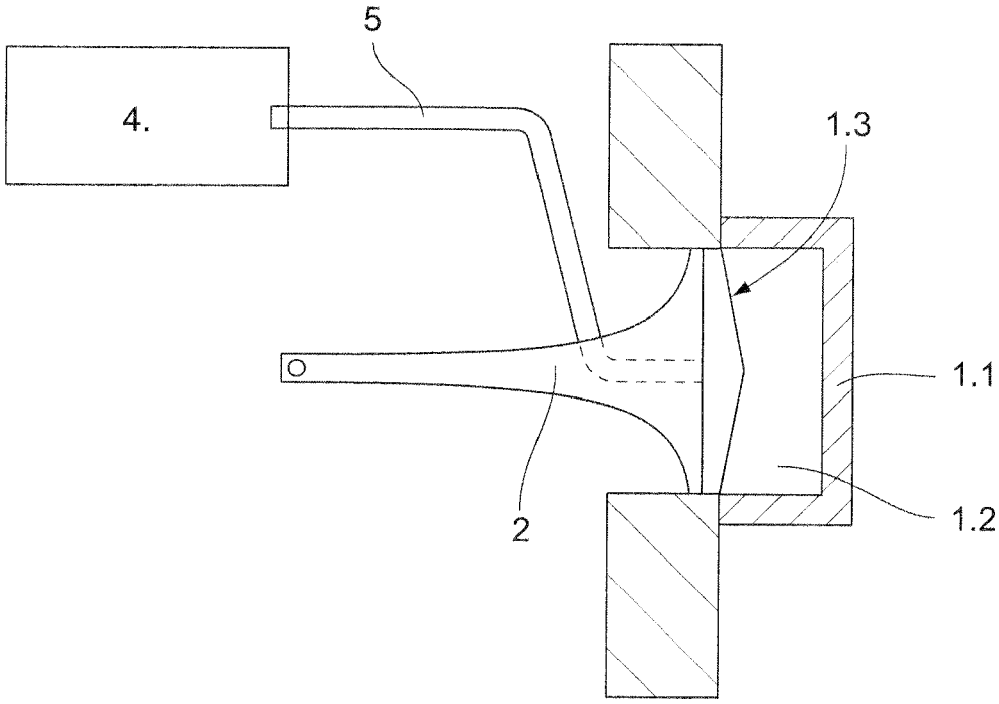
Figure 8:
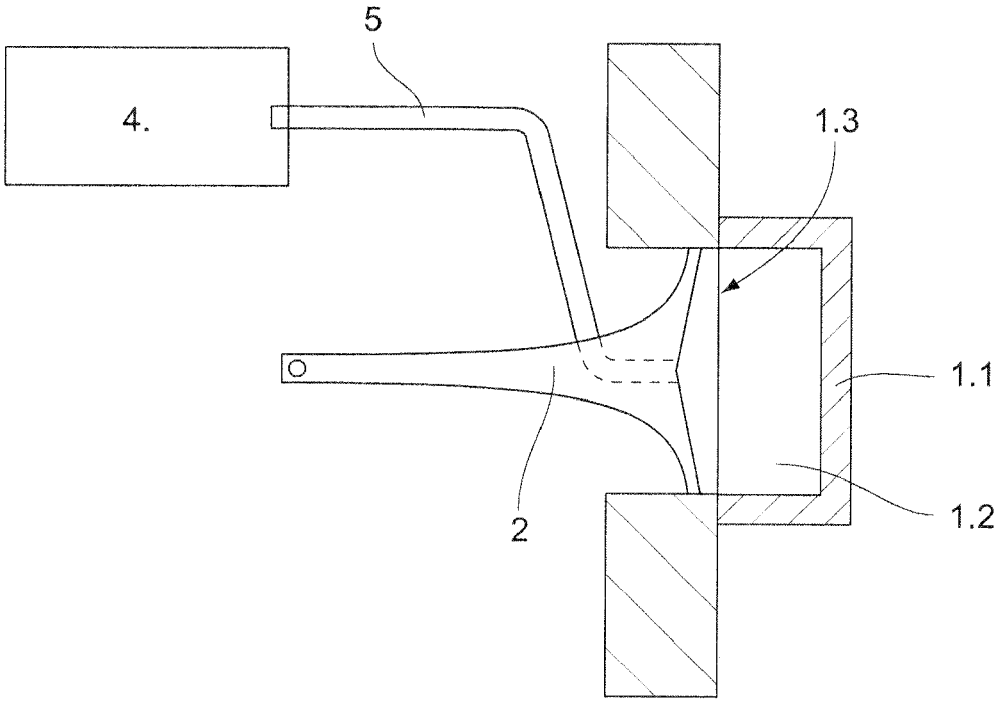

FIGS. 7 and 8 illustrate different preferred forms of the drive means and membrane in a membrane pump of the device.

DETAILED DESCRIPTION OF THE PREFERRED EMBODIMENTS

A fluid circulation device according to the present invention comprises at least one membrane pump that generally is associated with a valve upstream and a valve downstream in order to define the flow direction of the fluid pumped.

Contrary to the membrane pumps used in known fluid circulation devices where the membrane is moved by pressure of a gaseous fluid, a rigid junction between the membrane and a drive means can be realized in the present invention, with the result that the displacements of this membrane are precisely known, which in turn allows one to know and regulate with precision the flowrate or volume of the fluid circulated.

The essential characteristic of the fluid circulation device according to the invention resides in the fact that this device includes one or several fluid circuits, each having a rigid cavity with one wall formed by a membrane, this membrane being held to the surface of an actuator element or sensor by negative pressure.

Thus, the membrane displacements are precise, and allow the liquid volume pumped or the pressure of the liquid pumped to be determined while the part of the fluid circuit comprising the membrane is made so that it can be taken off or replaced.

The membrane pump according to the invention comprises a rigid cavity within which the membrane is displaced under the effect of mechanical drive means actuated in their to-and-from displacements with the aid of an electric, hydraulic, pneumatic, mechanical or any other type of motor. One side of these drive means is in contact with the membrane, and the membrane is made to stick to this face of the drive means by a vacuum created between this membrane and this face of the drive means, the vacuum being created by an associated vacuum pump. In this way the membrane, when functioning, very exactly follows the displacements of the drive means, yet with this design it is possible when the circulation device is idle, to separate the membrane from its drive means in order to change the fluid circulation circuit, which particularly in medical equipment is a throw-away item.

The link thus established lacks elasticity, and on the one hand allows one to avoid a direct contact between potentially contaminated parts and the fluid to be circulated, and on the other hand to precisely know the volume displaced in a to-and-from cycle of the membrane, in a way that is little sensitive or insensitive to different parameters such as the pressure and the temperature, as will be seen hereinafter.

Such a realization of the membrane pump is advantageous when used in devices or equipment including several membrane pumps, as for instance in the medical, food, chemical, or laboratory field.

A pump according to the present invention obviates the disadvantages of existing devices that have been cited before, since the gas, or here rather the gas vacuum, is only used to make the membrane stick to a mechanical, rigid part that itself is driven in whatever way but with a precise knowledge of the displacement that it inflicts upon the membrane. Owing to the rigidity of the assembly, the transmission of force and the displacement are no longer sensitive to the common parameters such as for instance the pressure of the fluid to be circulated.

Such a realisation is particularly interesting when applied to equipment including several membrane pumps. In this case, actually a single vacuum pump is sufficient for creating and maintaining the contact between the different membranes and their corresponding drive systems. The air vacuum can be realized with any model of vacuum pump that can be connected with one or several elements to be serviced, the vacuum being controlled and maintained all along the process even when slight leaks exist.

If, moreover, the equipment is for medical use, such as dialysis equipment, it will also commonly include several pressure sensors, and the same principle may be applied to the sensors thus bringing an additional advantage. Actually with a vacuum pump one can realize in the least expensive way the coupling between a membrane and the sensor by suction of air between the membrane and the sensor, which will then be directly subjected to the force resulting from the pressure of the liquid present on the other side of the membrane.

Figure 1:
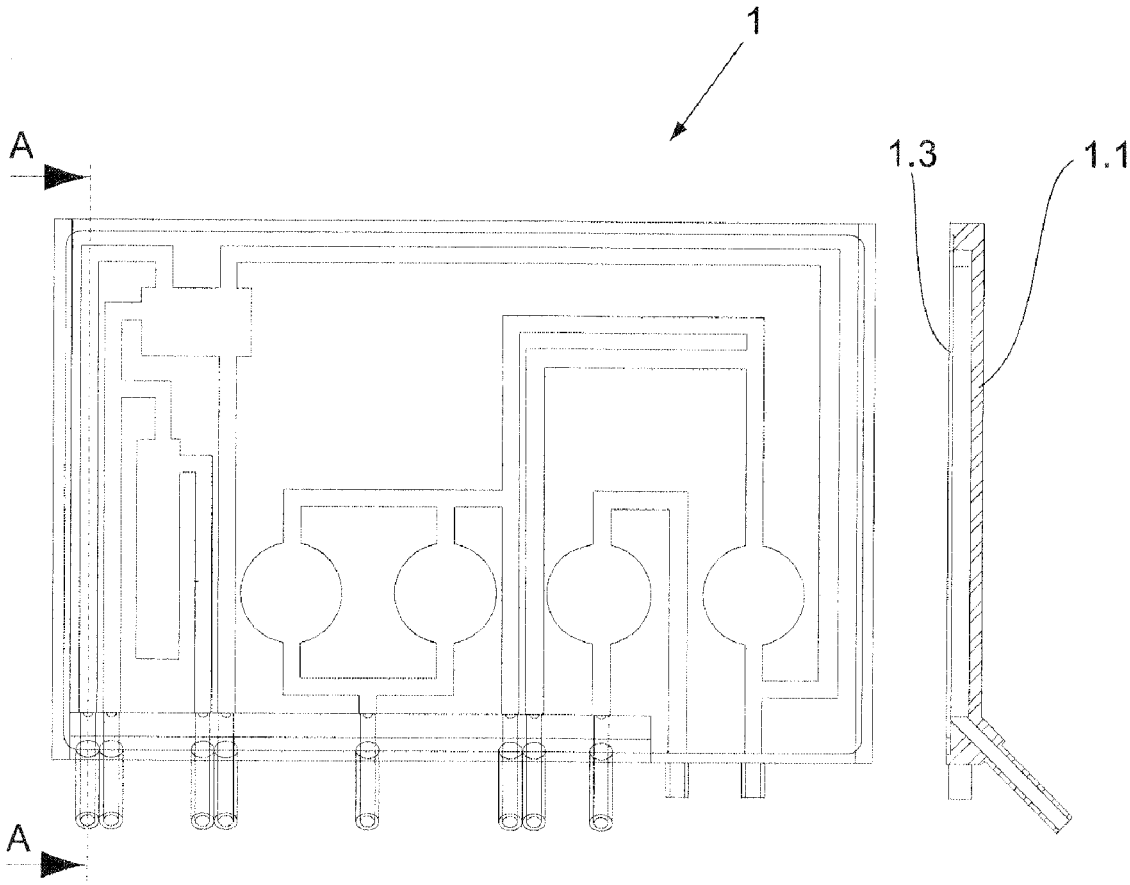
FIG. 1 illustrates schematically in a view and in section a fluid circuit containing the device.
Figure 2:
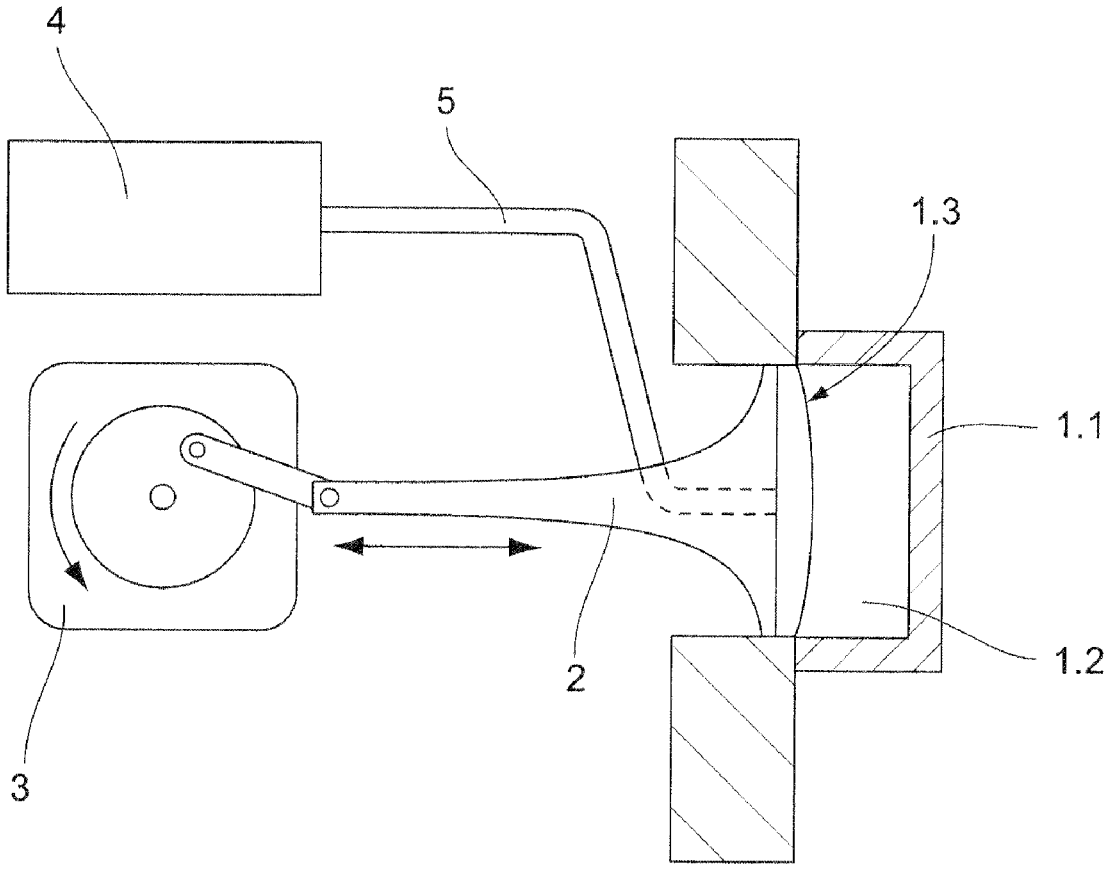
FIG. 2 is a basic scheme of a membrane pump that comprises the circuit illustrated in FIG. 1.

As represented in FIGS. 1 and 2, a device according to the present invention includes a circulation circuit 1 of the fluid to be pumped, with one segment 1.1 that may be detachable, and includes a rigid cavity 1.2 of which one wall consists of a membrane 1.3. In the example illustrated, this circuit 1 includes one valve 1.4 upstream and one valve 1.5 downstream that are connected upstream and downstream, respectively, to the rigid cavity 1.2 of this circulation circuit 1.

The membrane 1.3 of segment 1.1 of the circulation circuit 1 cooperates with the front face of drive means 2 induced into a to-and-from movement by a motor 3. The membrane 1.3 is made to stick to the front face of drive means 2 by the negative pressure created by a vacuum pump 4 connected via a conduit 5 to a hole in the front face of drive means 2. Thus, while the vacuum pump 4 functions, the negative pressure created between the front face of drive means 2 and the membrane 1.3 secures the rigid connection between this membrane 1.3 and the drive means 2, in such a way that membrane 1.3 exactly follows all displacements of these drive means 2.

In a preferred embodiment, the drive motor 3 is an electric motor having a rotor connected via a crankshaft to the drive means 2. Thus, the rotary motion of the motor 3 that is transformed to a to-and-from motion of the drive means 2 drives the membrane 1.3 so as to increase and decrease in alternation the volume of the rigid cavity 1.2 of the fluid circuit 1.

As illustrated in FIG. 3, the valves placed one upstream and the other downstream of the membrane 1.3 provide control of the flow direction of the fluid thus pumped. In the preferred embodiment of the invention, the valves are controlled by cams 6, 7 represented in FIG. 4, which are placed onto the shaft of motor 3. This preferred mode secures low costs of fabrication and a high reliability of the system.

FIG. 5 shows that a setup also making use of a vacuum pump and of a fluid circuit 1 including a soft membrane 1.3, when replacing the motor 3 by a sensor 8, allows one to measure the pressure present in the circuit, both at positive and at negative values, thanks to the connecting force thus created by the vacuum between the membrane 1.3 and the sensor 8.

FIG. 6 schematically represents a device according to the invention that includes a plurality of circuits 1 each including one membrane 1.3 connected, as previously described, to drive means 2 or to a pressure sensor 8. Using a single vacuum pump 4 and a vacuum manifold 10, one can press the membranes 1.3 of all circuits 1 against the corresponding drive means 2 or sensor 8.

Manifold 10 can be passive, and merely include feeders permanently interconnected in such a way that all pumps and sensors are simultaneously subjected to the vacuum. In this mode, which is of interest owing to its simplicity and lowest costs, all connections will be affected if for whatever reason it is not possible to create a vacuum between one of the membranes and the associated drive means 2 or sensor 8. It is also not possible in this case to know which of the connections is responsible for the problem. Passive manifolds have the additional defect that the vacuum pump must be set up in dimensions proportional to the number of circuits 1, and thus the number of connections that must be established. It will therefore be preferable to use a vacuum manifold with valves so that one can connect each circuit 1 including the pumps and may be sensors, sequentially to the vacuum pump 4. These valves can be mechanical or controlled by a control unit 9. In any case it will be advantageous to place an indicator for the valve position (not represented) onto each valve, and connect it with the control unit 9 in order to know its position. Moreover, a pressure sensor 11 will advantageously be placed between the vacuum pump and the manifold, in order to detect possible leaks which where possible will be corrected. It will also be advantageous for this reason to connect the pressure sensor and the vacuum pump with the control unit, and also a discharge valve so that one can liberate the connection or connections between membranes and drive means, by breaking the air vacuum.

For full benefit from the advantages offered by the preferred mode described hereinabove, the control unit 9 could for instance control the valves in the following way. It starts by closing all valves except one, and starts up the vacuum pump. When a negative pressure that is found to be sufficient is attained, the processor opens a second valve, and so on until all valves are open and the negative pressure is beneath a certain threshold. The processor then stops the vacuum pump and continues to measure the pressure with sensor 11. If this pressure increases, which indicates that a leak is present, the processor may then restart the vacuum pump, and actuate the valves according to needs, so as either to resolve the problem or provide a diagnosis.

So that the sophisticated means described above will yield the results expected, it will in addition be necessary that the shape of membrane 1.3 and the shape of the surfaces of the connecting means or drive means 2 that are in contact with said membrane, are matched so as to secure the vacuum all over the contact surface. In a preferred mode, the corresponding shapes will also allow one to reduce the air volume between the membrane and the surface prior to evacuation, and to easily evacuate the air that is present. As an example, the preferred mode satisfying these criteria implies that one of the two surfaces is a cone, and the other a plane, the hole connected to the vacuum pump being located in the middle of the face of the connecting means.

In another example, both faces would be planar, those of the connecting means being pierced with many small holes connected with the vacuum pump and securing evacuation of the air.

FIG. 7 illustrates a membrane 1.3 in the shape of a nozzle exhibiting a free surface outside the circuit, concave and cone-shaped. The front face of the drive means 2 or sensor 8 with which this membrane 1.3 cooperates will then be planar.

FIG. 8 illustrates a membrane 1.3 that is planar and cooperates with a front face of a drive means 2 or sensor 8 exhibiting a concave cone shape.

It is to be understood that numerous variants can be envisaged, both for the shape of membranes 1.3 and of the surfaces with which they must cooperate, as well as for the mode of driving the drive means 2 in their to-and-from movement.

The invention claimed is:

1. A fluid circulation device, comprising:

a circuit of fluid to be pumped, with a rigid cavity, walls of the rigid cavity not being covered by any membrane;

a soft membrane that closes the rigid cavity;

means for driving that cooperates with the soft membrane;

a motor that drives the means for driving in to-and-fro movements, wherein a face of the means for driving intended to cooperate with the soft membrane is connected via a conduit to a vacuum pump able to apply by suction the membrane against said face of the means for driving, so as to create a rigid connection between the means for driving and said membrane that will then exactly follow the to-and-fro movements imposed by the means for driving.

2. The device according to claim 1, wherein the to-and-fro movements of the means for driving are created by a rotating motor and a kinematic chain transforming the rotating movement of the motor into a linear to-and-fro movement.

3. The device according to claim 2, further comprising:

valves arranged in the circuit upstream and downstream from the rigid cavity and the soft membrane, and the valves are controlled by cams driven by the motor.

4. The device according to claim 3, wherein a shape of the soft membrane is conical concave, and a corresponding surface of the means for driving is planar.

5. The device according to claim 3, wherein a shape of the soft membrane is planar, and a corresponding surface of the means for driving is conical concave.

6. The device according to claim 3, wherein the device includes several circuits the soft membranes of which cooperate, each with a corresponding means for driving, and a single vacuum pump sucks all soft membranes against their corresponding means for driving.

7. The device according to claim 2, wherein a shape of the soft membrane is conical concave, and a corresponding surface of the means for driving is planar.

8. The device according to claim 2, wherein a shape of the soft membrane is planar, and a corresponding surface of the means for driving is conical concave.

9. The device according to claim 2, wherein the device includes several circuits the soft membranes of which cooperate, each with a corresponding means for driving, and a single vacuum pump sucks all soft membranes against their corresponding means for driving.

10. The device according to claim 2, wherein the soft membrane cooperates with the means for driving connected with a pressure sensor.

11. The device according to claim 1, wherein a shape of the soft membrane is conical concave, and a corresponding surface of the means for driving is planar.

12. The device according to claim 11, wherein the device includes several circuits the soft membranes of which cooperate, each with a corresponding means for driving, and a single vacuum pump sucks all soft membranes against their corresponding means for driving.

13. The device according to claim 1, wherein a shape of the soft membrane is planar, and a corresponding surface of the means for driving is conical concave.

14. The device according to claim 13, wherein the device includes several circuits the soft membranes of which cooperate, each with a corresponding means for driving, and a single vacuum pump sucks all soft membranes against their corresponding means for driving.

15. The device according to claim 1, wherein the device includes several circuits the membranes of which cooperate, each with a corresponding means for driving, and a single vacuum pump sucks all soft membranes of the several circuits against their corresponding means for driving.

16. The device according to claim 15, wherein the vacuum pump is connected with a vacuum manifold that in turn is connected to each means for driving via a conduit.

17. The device according to claim 16, wherein the device includes a control unit controlling the vacuum manifold for a sequential connection of each means for driving to the vacuum pump.

18. The device according to claim 1, wherein the cooperates with the means for driving connected with a pressure sensor.

* * * * *